US008282945B2

(12) United States Patent
Mammone

(10) Patent No.: US 8,282,945 B2
(45) Date of Patent: Oct. 9, 2012

(54) APPLICATION OF COMESTICS

(75) Inventor: Rocco Mammone, Avondale Heights (AU)

(73) Assignee: Majic Beauty Pty Ltd, Victoria (AU)

( * ) Notice: Subject to any disclaimer, the term of this patent is extended or adjusted under 35 U.S.C. 154(b) by 1093 days.

(21) Appl. No.: 10/332,169

(22) PCT Filed: Jul. 5, 2001

(86) PCT No.: PCT/AU01/00807

§ 371 (c)(1), (2), (4) Date: Jan. 3, 2003

(87) PCT Pub. No.: WO02/01982

PCT Pub. Date: Jan. 10, 2002

(65) Prior Publication Data

US 2004/0037858 A1 Feb. 26, 2004

Related U.S. Application Data

(60) Provisional application No. 60/251,176, filed on Dec. 4, 2000.

(30) Foreign Application Priority Data

Jul. 5, 2000 (AU) ..... PQ 8580
Jan. 24, 2001 (AU) ..... PR 2695

(51) Int. Cl.
*A61K 8/02* (2006.01)
*H05C 1/00* (2006.01)
*B05D 3/08* (2006.01)

(52) U.S. Cl. ..... 424/401; 427/458; 427/472; 427/2.14

(58) Field of Classification Search ..... 424/401
See application file for complete search history.

(56) References Cited

U.S. PATENT DOCUMENTS

| | | | | |
|---|---|---|---|---|
| 3,256,980 | A * | 6/1966 | Gordon | 401/75 |
| 4,654,235 | A * | 3/1987 | Effenberger et al. | 427/407.3 |
| 4,725,495 | A * | 2/1988 | Garbe et al. | 428/335 |
| 4,747,782 | A | 5/1988 | Campbell, Jr. et al. | |
| 4,925,667 | A | 5/1990 | Fellows et al. | |
| 5,137,040 | A | 8/1992 | Iosilevich et al. | |
| 5,301,697 | A | 4/1994 | Gueret et al. | |
| 5,462,798 | A * | 10/1995 | Gueret | 428/364 |
| 6,214,362 | B1 * | 4/2001 | Page | 424/402 |
| 6,235,270 | B1 * | 5/2001 | Ishii et al. | 424/59 |
| 6,283,664 | B1 * | 9/2001 | Gueret | 401/261 |
| 6,530,379 | B2 | 3/2003 | Iosilevich | |

FOREIGN PATENT DOCUMENTS

| | | |
|---|---|---|
| EP | 0 832 577 | 4/1988 |
| JP | 63105189 | 5/1988 |
| JP | 09295917 A * | 11/1997 |
| WO | WO 00/00059 | 6/2000 |

* cited by examiner

*Primary Examiner* — Michael G Hartley
*Assistant Examiner* — Nabila Ebrahim
(74) *Attorney, Agent, or Firm* — Volpe and Koenig, P.C.

(57) ABSTRACT

A cosmetics applicator includes a material surface (210) and a cosmetic preparation (220) provided on the surface. In one aspect, the cosmetics preparation is retained on the surface at least in part with the assistance of electrostatic attraction between the surface and the cosmetics preparation. In another aspect, a waxy or oily underlay is provided between the surface and the cosmetics preparation, and the material of the surface is selected to facilitate retention of the cosmetics preparation and the underlay while allowing a major proportion of the cosmetics preparation retained thereon to be transferred to a human skin surface in a single wiping pass of the cosmetics preparation across the skin surface.

45 Claims, 2 Drawing Sheets

APPLICATION OF COMESTICS

FIELD OF THE INVENTION

The invention relates to cosmetics, and relates particularly, but not exclusively, to improvements in the application of cosmetics.

BACKGROUND OF THE INVENTION

Cosmetics preparations of various types have been in use for many, many years. Accordingly, a wide range of application methods have been trialed, though primarily facial cosmetics are applied using a pencil, brush or stick, or other similar means.

This approach has been generally satisfactory. However, there are a number of problems associated with existing techniques of packaging and applying facial cosmetics. Among these problems is the difficulty some have in effectively applying cosmetics using conventional techniques. Also, some experience considerable difficulty in mastering the techniques required to successfully apply cosmetics preparations with sufficient competence to achieve the required effect.

Many individuals have particular difficulty with self application of eye-shadow. This is typically applied with mixing brushes and the challenge is to achieve even shading or colouring of each eye without smudging and to make up both eyes without noticeable differences. This aspect of distinct separated zones that need to be matched does not arise with most other areas of cosmetics application. Current methods of applying eye shadow can take up to 10 to 15 minutes for self-application, and even then, for the reasons just mentioned, the result may be less than perfect, leaving the user doubtful about feeling confident about her eye make-up through the day. This combination of the time required, the difficulty involved, and uncertain results, including worrying about smudging, colour outcome, messiness and an amateurish appearance, has led many women to avoid using eye make-up altogether.

The present applicant believes that these issues with eye cosmetics also arise, though usually to a lesser degree, with other aspects of cosmetics self-application, most notably lipstick.

Further, existing methods of packaging cosmetics can cause, in some cases, considerable inefficient wastage of the actual cosmetics preparation. As preparations are often relatively expensive to produce, this inherent wastage necessarily increases the price of the packaged forms of the cosmetics.

U.S. Pat. Nos. 4,925,667 and 4,752,496 disclose cosmetic samplers in which sample volumes are retained on a substrate, covered and accessed by removal of a tear strip. U.S. Pat. Nos. 5,690,130 and 119,704 describe cosmetic samplers in which fabric fibres or non woven material may be applied to cover an entire surface of a substrate to form an applicator surface, and in which the fibres are initially applied "by electrostatic assist". The cosmetic is retained on this substrate by an overlaid thermoplastics film.

It is, accordingly, an object of the present invention to attempt to address the aforementioned difficulties relating to cosmetics application.

SUMMARY OF THE INVENTION

The inventive concept resides in a recognition that cosmetics preparations are advantageously provided by retaining a suitable amount of a cosmetics preparation on a suitable surface, so that the surface can be used to conveniently apply the cosmetics preparation to an appropriate part of the face.

In a first aspect, the invention provides a cosmetics applicator including a material surface and a cosmetics preparation provided on the surface. The cosmetics preparation is retained on, and may be initially attracted to, the surface at least in part with the assistance of electrostatic attraction between the surface and the cosmetics preparation. The material of the surface is preferably selected to facilitate retention of the cosmetics preparation thereon by said electrostatic attraction while allowing a major proportion of the cosmetics preparation retained thereon to be transferred to a human skin surface in a single wiping pass of the cosmetics preparation across the skin surface.

In a second aspect, the invention provides a cosmetics applicator including: a material surface, a cosmetics preparation provided on said surface, and a waxy or oily underlay between said surface and said cosmetics preparation, wherein the material of said surface is selected to facilitate retention of said cosmetics preparation and said underlay while allowing a major proportion of the cosmetics preparation retained thereon to be transferred to a human skin surface in a single wiping pass of the cosmetics preparation across the skin surface.

Advantageously, said waxy or oily underlay is cosmetic foundation. Preferably, the underlay transfers with said cosmetics preparation during said wiping pass to provide an outer protective coating therefor.

Advantageously, said material surface is provided on a planar sheet shaped to provide a first portion defining said surface and a second portion to be gripped between fingers or thumb and a finger, for executing said single wiping pass. The first portion may typically be larger than the second portion.

Preferably, said material is provided as a planar sheet. Preferably, the planar sheet of material is cut to an appropriate shape and size to allow said cosmetics applicator to be conveniently used as required.

The surface preferably has a relatively low coefficient of friction. For this purpose, the surface may be substantially formed of PTFE (poly-tetrafluoroethylene), otherwise known as Teflon®, or of a PTFE-containing composite.

Preferably, the aforesaid electrostatic attraction is achieved by the surface of the material being electrostatically charged.

The cosmetics preparation may be, eg, a granular, dust-like or powder-based substance such as, for example, as eyeshadow; or a creme, wax or other liquid-based preparation such as, for example, lipstick, or foundation.

When the cosmetics preparation is a powder, it may be applied to the surface of the material using a spray directed towards the surface, Preferably, the spray of the cosmetics preparation is efficiently directed to the material by virtue of the electrostatic attraction between the surface and the cosmetics preparation.

Preferably, the surface is shaped and sized to allow convenient use of the cosmetics preparation. Preferably, the surface includes a covered region to which the cosmetics preparation is applied, and a clear region to which the cosmetics preparation is not applied. Advantageously, the cosmetics preparation includes different colours of the preparation in distinct areas of the surface to facilitate different colour effects when the cosmetics applicator is used.

The invention further provides a method of providing a cosmetics applicator, the method including: providing a material having a surface; and applying a cosmetics preparation to at least part of the surface; wherein the cosmetics preparation is attracted to and/or retained on the surface at least in part with the assistance of electrostatic attraction between the surface and the cosmetics preparation.

The cosmetics preparation may be applied to the surface by spraying.

Preferably, the method further includes applying on said surface, a stencil to confine the cosmetics preparation to one or more predetermined areas of the surface.

The invention still further provides a method of applying a cosmetics preparation to a skin surface from a cosmetics applicator as aforedescribed, comprising transferring said cosmetics preparation from the applicator surface to the skin surface in a single wiping pass of the cosmetics preparation across the skin surface.

DESCRIPTION OF EMBODIMENTS

Figure 3:
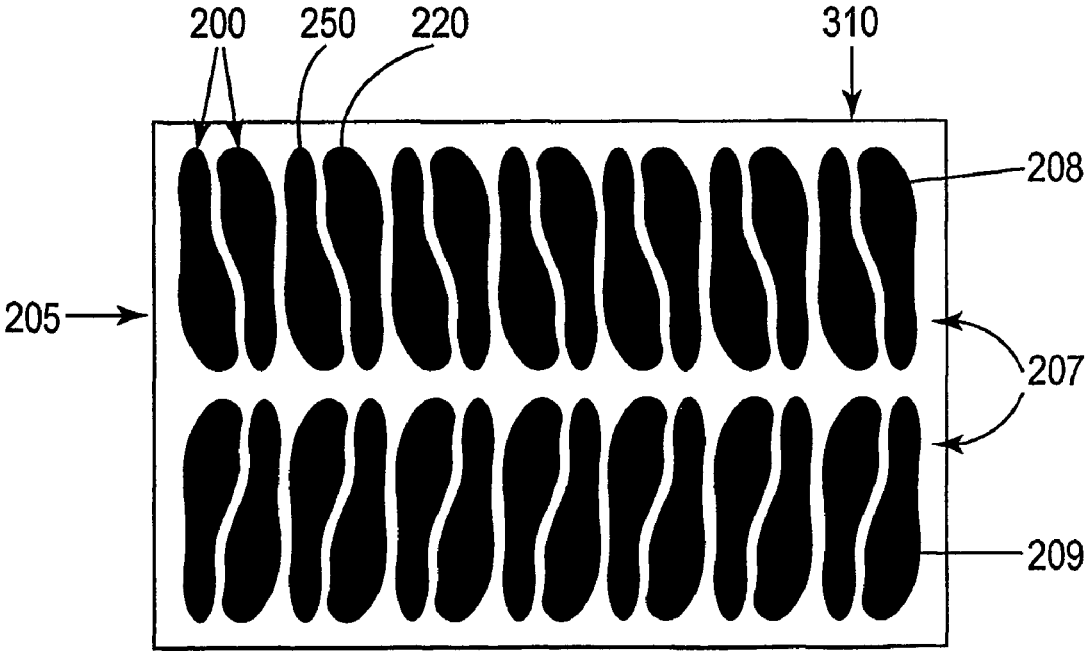
FIG. 3 is a representation of a set of cosmetic applicators of a shape a little different from those depicted in FIG. 1, and produced by the facility depicted in FIG. 2.

A cosmetics applicator 200 constructed in accordance with an embodiment of the invention will now be described with reference to the accompanying drawings. Manufacture of the cosmetics applicators is achieved using a production facility 10 as schematically represented in FIG. 2. A sheet of cosmetics applicators 200 that are produced using this facility 10 are represented in FIG. 3. An enlarged presentation of a cosmetic applicator is provided by FIG. 1.

Figure 1:
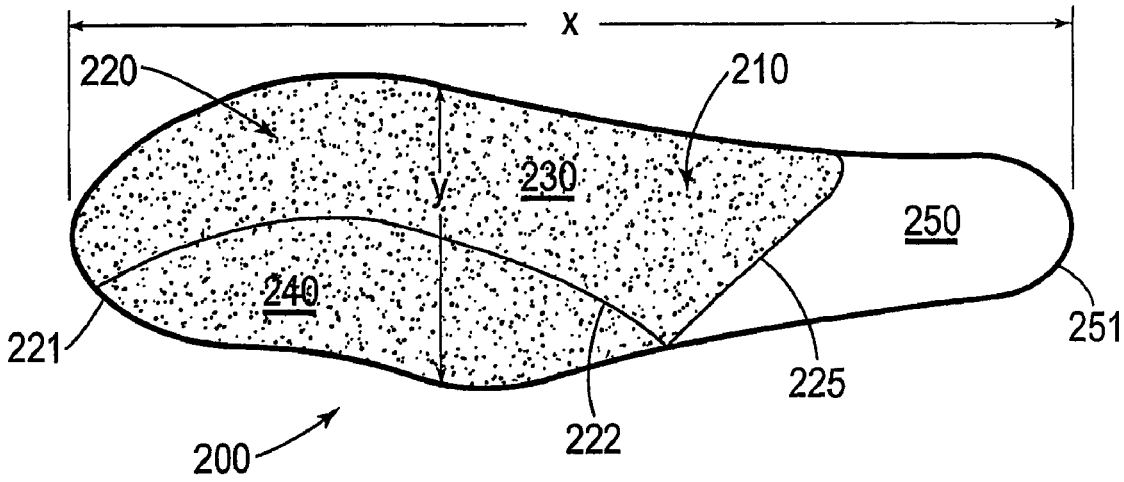
FIG. 1 is an enlarged representation of a cosmetics applicator according to an embodiment of the invention, especially suitable for retaining and applying eyeshadow.
Figure 2:
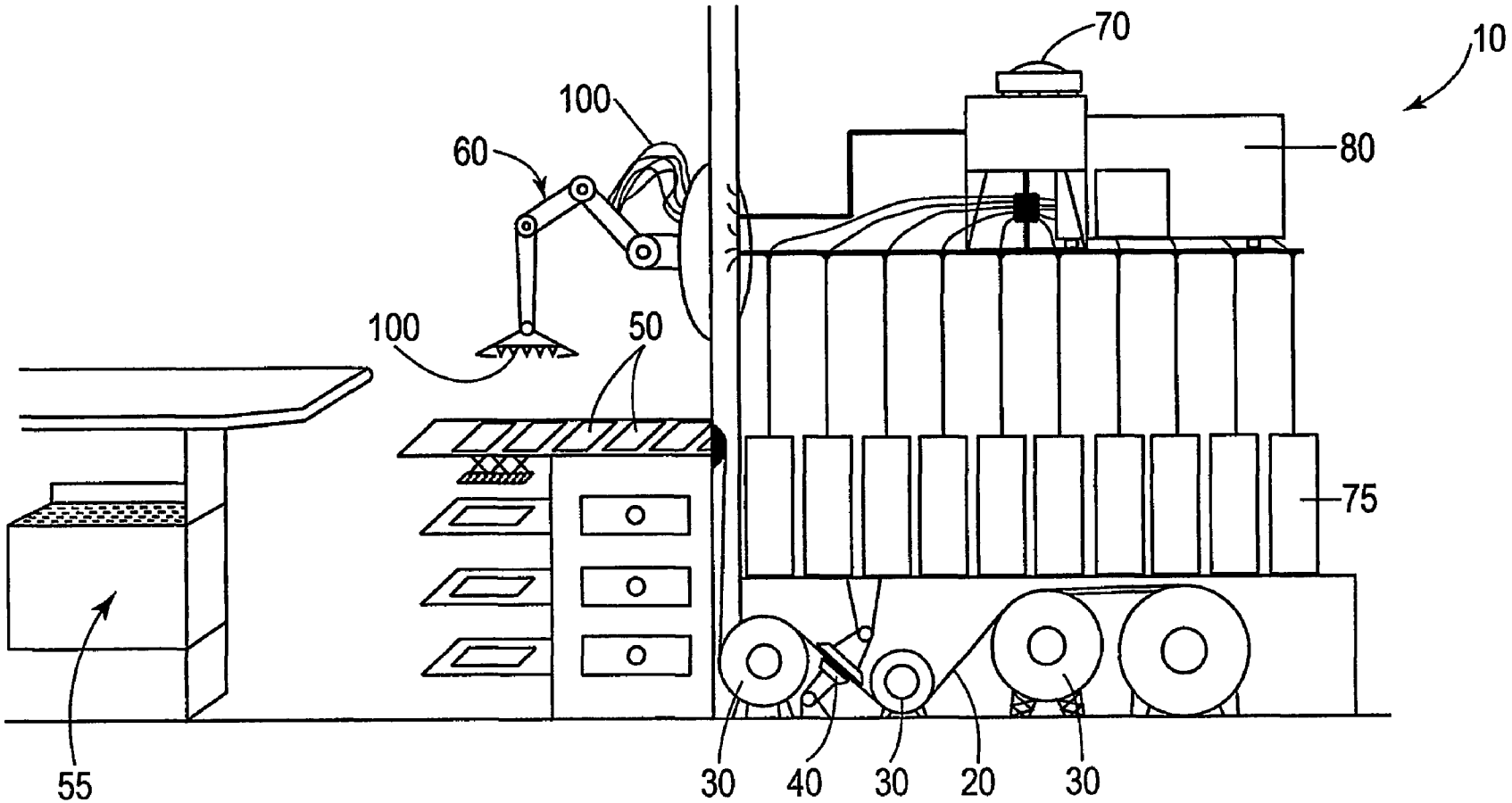
FIG. 2 is a schematic representation of a facility used to manufacture cosmetic applicators of the kind depicted in FIG. 1.

The cosmetics applicator 200, illustrated on an enlarged scale with a magnification a little greater than 2, is represented in FIG. 1, and includes a surface 210 of a selected highly flexible PTFE containing material. The surface 210 can be considered as being divided into a relatively larger first portion 220 and a relatively smaller second portion 250. Larger portion 220 is covered with an underlay of a waxy or oily substance such as cosmetic foundation, overlaid with an outer layer of cosmetics preparation such as, for example, coloured make-up powder. Relatively smaller second portion 250 is clear and uncovered. Portions 220, 250 meet at a boundary 225 marked by an edge of the powder layer and are defined at least in part by generally curved edges 221, 251 of sheet 200.

The portion 220 may be divided at a boundary 222 into a first region 230 and a second region 240, which are respectively overlaid with different colours and/or types of cosmetics preparation. The first and second regions 230, 240 of the portion 220 are positioned so that the two respective colours of these regions 230, 240 are similarly represented on the skin of the eyelid. While a simple arrangement of only two regions 230, 240 is depicted in FIG. 1, intended to apply different colours respectively to the upper and lower portions of the eyelid, a wide variety of different colours, or of graded colour tones, of cosmetics preparation can be applied to the surface 210 of the applicator 200.

The "teardrop" shape of the surface 210 shown in FIG. 3 is particularly suited for use of the cosmetics applicator 200 for applying cosmetic colouring, eg. eyeshadow, to the eyelids. As the clear portion 250 of the surface 210 is not covered with cosmetics preparation, it can be gripped between the thumb and forefinger. With the applicator 200 being held in this way, the index finger can be used to apply pressure to the back of the applicator 200 (which is, of course, disposed opposite the surface 210 and not covered with cosmetics preparation) so that most of the cosmetics preparation, together with the underlay, on the covered portion 220 of the applicator 200 rubs off onto, ie. is transferred to, the skin of the eyelid in a single wiping pass or swipe of the cosmetics preparation across the skin surface. The actual proportion of eyeshadow transferred will typically depend on the actual finger pressure applied to the applicator as it is wiped across the eyelid. The original underlay forms an outer protective and/or seal coating that assists in stabilising and maintaining the eyeshadow over subsequent hours.

The transfer efficiency of this wiping action is facilitated by the generally curved edges of applicator 200, by the elongated shape of the applicator, and by portion 220 being of a length and width to generally match an eyelid.

The surface 210 is of a PTFE-containing material having a low coefficient of friction, selected to facilitate retention of the cosmetics preparation and underlay thereon, preferably at least in part by electrostatic attraction, while allowing the major proportion of the cosmetics preparation retained thereon to be transferred to a human skin surface in a single wiping pass or swipe of the cosmetics preparation across the skin surface. The cosmetics preparation thus readily wipes off the surface 210 and onto the skin. The material should thus preferably be suitable both for being electrostatically charged at its surface and for having friction properties such that the cosmetics preparation, and preferably also the underlay, easily transfer by wiping action to the skin.

A suitable PTFE-containing material for applicators 200 is FL100 Virgin PTFE supplied by Dotmar EPP, preferably of thickness 4 to 5 thousandths of an inch (about 0.100 to 0.125 mm), having a static co-efficient of friction at 0.23 MPa of 0.04 and a dynamic co-efficient of friction at 0.23 MPa, 0.75 m/sec of 0.05. The specific gravity is 2.16, tensile strength 30.0 MPa, flexural modulus 690 MPa, and compressive strength under 5% strain 12.1. Shore D Hardness is in the range 50-65.

Other PTFE-containing materials that may be suitable include PTFE-impregnated or coated paper or fibre, eg. glass fibre, mesh, or PTFE-coated plastics substrates.

Electrostatic attraction between the cosmetics preparation and the surface 210, at least partly assists in retaining the cosmetics preparation to the surface 210 prior to it being wiped off. The waxy or oily underlay further assists in this retention. There is typically no outer protection film but such may be included if necessary for additional protection of the cosmetic.

The principal dimensions of applicator 200 are, with reference to FIG. 1, about 60 to 75 mm for x and about 15 to 25 mm for y. Thus, the applicator is elongate with a length to width ratio in the region of 3 to 4.

The surface 210 is cut from a sheet of the PTFE-containing material, and electrostatic attraction between the surface 210 and the cosmetics preparation assists in attracting the preparation to, and retaining it on, the portion 220 of the surface 210.

The cosmetics applicator 200 can be manufactured by means of the production facility illustrated schematically in FIG. 2. A roll of sheet comprising the selected PTFE—containing material is spooled, using rolls 30, between opposed friction plates 40 that develop an electrostatic charge on the material 20 as the material 20 runs between the plates 40. The sheet 20 is cut into individual rectangular sheets 50, which are fed along a conveyor line towards a robotic applicator 60. A stencil, which has holes for the covered portions 220 of each of the applicators 200 placed on a given sheet 50, is placed over each sheet.

The robotic applicator 60 is used to apply the waxy or oily underlay and then the cosmetics preparation onto each sheet 50. The cosmetics preparation, a coloured powder material, is supplied to a mixing vat 70 for colour tanks 75, and mixed with air from an air tank 80. Various colours of aerated powder of the cosmetics preparation are supplied to the robotic applicator 60 though powder lines 100. The air nozzles 110 deliver the actual aerated power to the stencil covered sheets 50 after application of the waxy or oily underlay. A computer control programme in controller 55 is used to control the actions of the robotic applicator 60 to ensure appropriate delivery of the aerated powder to the sheets 50.

After the cosmetics preparation has been applied to the stencil-covered sheets 50, the stencil can be removed, and a guillotine press used to stamp out individual applicators 200 according to the pattern shown in FIG. 3. Each block 205 of applicators 200 depicted in FIG. 3 can be supplied in a convenient package as required, for example laid out in a moulded tray 310 for easy grasping and use. The package thus forms a cosmetics application kit comprising an array of applicators 200 in a manually accessible receptacle. It will be seen that the applicators are stamped out in complementary pairs 207 of "left" and "right" applicators 208, 209, ie. the applicators are handed to facilitate application of the preparation to the left or right eye respectively.

In an alternative approach, instead of or in addition to application of the waxy or oily underlay, the surface of sheet 20 is prepared by being wiped with a suitable alcohol.

It is found that the use of a pair of applicators 200 to apply eyeshadow achieves very good balance between the two sides of the face and eyes, giving the user a high level of confidence in her appearance. The physical size of the required package for a set of the applicators is relatively compact and convenient. The applicators facilitate self-applications of eye makeup within seconds rather than the 10 or 15 minutes presently required.

The invention claimed is:

1. A cosmetics applicator including:

a) an applicator body having a front thin flexible non-permeable smooth planar material surface and a rear flexible surface that resiliently retains the front surface in the planar arrangement;

b) the front planar material surface having a first portion for holding between the fingers and a second teardrop portion shaped like an eyelid and deformable to fit over an eyelid, the second teardrop portion including poly-tetrafluoroethylene (PTFE) and having a relatively low coefficient of friction;

c) a coating of a waxy or oily layer on at least the second teardrop portion of the front surface as an underlay; and d) a coating of a powder-based cosmetics preparation in a first pattern on the coating of a waxy or oily layer;

the material of said front planar material surface being selected to facilitate retention of said cosmetics preparation thereon at least in part by electrostatic attraction;

the low coefficient of friction of the front planar material surface and said underlay allowing a major proportion of the cosmetic preparation to be transferred in a sliding manner to a human skin surface in substantially a single wiping pass of the cosmetics preparation in a second pattern on the skin surface substantially corresponding to the first pattern.

2. A cosmetics applicator according to claim 1, wherein said underlay is a cosmetic foundation.

3. A cosmetics applicator according to claim 2, wherein said underlay is configured to be transferred with said cosmetics preparation during said wiping pass to provide an outer protective coating.

4. A cosmetics applicator according to claim 1, wherein the material of said front planar material surface being selected to facilitate retention of said cosmetics preparation thereon at least in part by said electrostatic attraction.

5. A cosmetics applicator according to claim 4, wherein said first portion is relatively larger than said second teardrop portion.

6. A cosmetics applicator according to claim 5, wherein said first portion and said second portion are defined at least in part by generally curved edges of said body.

7. A cosmetics applicator according to claim 1 wherein PTFE of the second teardrop portion is in the form of a PTFE layer or a PTFE-containing composite, the PTFE layer or PTFE-containing composition having a thickness of about 4 to 5 thousandths of an inch (about 0.100 to 0.125 mm) and having a low surface co-efficient of friction.

8. A cosmetics applicator according to claim 1, wherein said electrostatic attraction is achieved by said surface of said material being electrostatically charged.

9. A cosmetics applicator according to claim 1, wherein said cosmetics preparation is an eye shadow.

10. A cosmetics applicator according to claim 9, wherein said cosmetics preparation has different colours in distinct areas of said front planar material surface, wherein the different colours form the first pattern on the applicator.

11. The cosmetics applicator of claim 1, wherein the underlay is cosmetic foundation, the material of said front planar material surface retains said cosmetics preparation through electrostatic attraction and retains said underlay.

12. A cosmetics applicator according to claim 11, wherein said underlay is configured to be transferred with said cosmetics preparation during said wiping pass to provide an outer protective coating therefor.

13. A cosmetics applicator according to claim 11, wherein said first portion is relatively larger than said second teardrop portion.

14. A cosmetics applicator according to claim 13, wherein said first portion and said second portion are defined at least in part by generally curved edges of said body.

15. A cosmetics applicator according to claim 11, wherein the second teardrop portion is substantially formed of PTFE (poly-tetrafluoroethylene) or of a PTFE-containing composite.

16. A cosmetics applicator according to claim 11, wherein said cosmetics preparation is an eye shadow.

17. A cosmetics applicator according to claim 16, wherein said cosmetics preparation has different colours in distinct areas of said front planar material surface, wherein the different colours form the first pattern on the applicator and are transferred to the human skin surface in the first pattern.

18. The cosmetics applicator of claim 1 wherein the underlay is between said front planar material surface and said cosmetics preparation, and the underlay provides an outer protective coating therefor.

19. A cosmetics applicator according to claim 18, wherein said front planar material surface is a surface of a planar sheet.

20. A cosmetics applicator according to claim 19, wherein said planar sheet is a flexible sheet.

21. A cosmetics applicator according to claim 20, wherein said planar sheet is shaped to provide a first portion defining said front planar material surface and a second portion to be gripped between fingers or between thumb and a finger for executing said single wiping pass.

22. A cosmetics applicator according to claim 21, wherein said first portion is relatively larger than said second portion.

23. A cosmetics applicator according to claim 22, wherein said first portion and said second portion are defined at least in part by generally curved edges of said planar sheet.

24. A cosmetics applicator according to claim 23, wherein said planar sheet is elongated and said first portion is of a length and width to generally match an eyelid.

25. A cosmetics applicator according to claim 8, wherein said front planar material surface has a relatively low coefficient of friction like PTFE (poly-tetrafluoroethylene).

26. A cosmetics applicator according to claim 25, wherein said front planar material surface is substantially formed of PTFE (poly-tetrafluoroethylene) or of a PTFE-containing composite.

27. A cosmetics applicator according to claim 18, wherein said cosmetics preparation is a granular, dust-like or powder-based substance.

28. A cosmetics applicator according to claim 18, wherein said cosmetics preparation is an eye shadow.

29. A cosmetics applicator according to claim 18, wherein said cosmetics preparation has different colours in distinct areas of said front planar material surface to facilitate different colour effects when the cosmetics applicator is used.

30. A cosmetics applicator according to claim 1 with said front planar material surface being substantially formed of PTFE or of a PTFE-containing composite.

31. The cosmetics applicator of claim 1 wherein the planar material surface comprises a flexible sheet, the underlay is a cosmetic foundation and is located between said surface and said cosmetics preparation; and the front planar material surface being substantially formed of PTFE or of a PTFE-containing composite facilitating retention of said cosmetics preparation thereon and facilitating the transfer in a sliding manner to a human skin surface.

32. The cosmetics applicator of claim 1, wherein the front planar material surface has two regions that retain the cosmetics preparation, each region comprising different cosmetics preparations.

33. The cosmetics applicator of claim 32, wherein the different cosmetics preparations have different colors.

34. The cosmetics applicator of claim 1, further comprising at least two cosmetic zones defined on the front surface;

wherein the PTFE is provided in the front surface in the form of at least one of the group consisting of a PTFE layer, PTFE-impregnated paper, PTFE-coated paper, PTFE fiber, and PTFE-coated plastic substrates, the surface having a static co-efficient of friction of 0.04 and a dynamic co-efficient of friction of 0.05; and the coating of the powder-based cosmetics preparation includes at least two different colors of cosmetic, each different color of cosmetic in a different one of the at least two cosmetic zones.

35. The cosmetics applicator of claim 34, wherein the at least two cosmetic zones include at least four cosmetic zones and the at least two different cosmetic colors include at least four cosmetic colors.

36. The cosmetics applicator of claim 34, wherein the surface including PTFE is in the form of a PTFE-coated plastic substrate.

37. The cosmetics applicator of claim 34, wherein the surface including PTFE is in the form of a layer of PTFE.

38. The cosmetics applicator of claim 34, further comprising an electrostatic force between the cosmetics preparation and the surface, the electrostatic force assisting in retaining the cosmetics preparation to the surface prior the cosmetics preparation being transferred in the sliding manner to the human eyelid surface.

39. The cosmetics applicator of claim 34, having an X-direction corresponding to the width of an eyelid and a Y-direction corresponding to the height of an eyelid, the X-direction having a length between 60-75 mm, and the Y-direction having a width between 15-25 mm.

40. The cosmetics applicator of claim 1, wherein the front surface comprises at least two cosmetic zones;

the eyelid-shaped portion is formed of a material containing the PTFE, the front surface having a static co-efficient of friction of 0.04 and a dynamic co-efficient of friction of 0.05;

the coating of powder-based cosmetics preparation includes at least two different colors of cosmetic, each different color of cosmetic in a different one of the at least two cosmetic zones and forming a pattern on the applicator; and the corresponding pattern on the skin surface comprises the at least two different colors of cosmetic.

41. A kit comprising a package comprising:

a left applicator according to the cosmetic applicator of claim 1 comprising a flat left eyelid-shaped surface, the coating of a powder-based cosmetics preparation including a left powder-based cosmetics preparation resting on the left surface, and a right applicator according to the cosmetic applicator of claim 1 comprising a flat right eyelid-shaped surface, the coating of a powder-based cosmetics preparation including a right powder-based cosmetics preparation resting on the right surface, the kit including instructions to apply the cosmetics preparation on a left eyelid with the left applicator by applying the eyelid shaped surface to the left eyelid and wiping the surface across the left eyelid once ill a leftward sliding direction to transfer the left powder-based cosmetic to the left eyelid;

the kit including instructions to apply the cosmetics preparation on a right eyelid with the right applicator by applying the eyelid shaped surface to the right eyelid and wiping the surface across the right eyelid once in a rightward sliding direction to transfer the right powder-based cosmetic to the right eyelid.

42. The kit of claim 41 wherein the left powder-based cosmetics preparation includes at least two left colors of cosmetic and each of the at least two left colors of cosmetic are separated in a left pattern; the right powder-based cosmetics preparation includes at least two right colors of cosmetic and each of the at least two right colors of cosmetic are separated in a right pattern.

43. The kit of claim 42, wherein the left colors are different than the right colors.

44. The kit of claim 42, wherein the left pattern is different than the right pattern.

45. The kit of claim 42, wherein the at least one of the left colors is the same as at least one of the right colors and wherein the left pattern is different than the right pattern by the order of the colors from the top to bottom of the respective eyelids.

* * * * *